US008545240B2

(12) United States Patent
Casher et al.

(10) Patent No.: US 8,545,240 B2
(45) Date of Patent: Oct. 1, 2013

(54) CONNECTOR WITH TERMINALS FORMING DIFFERENTIAL PAIRS

(75) Inventors: Patrick R. Casher, North Aurora, IL (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/129,264

(22) PCT Filed: Nov. 13, 2009

(86) PCT No.: PCT/US2009/064300

§ 371 (c)(1), (2), (4) Date: Jul. 22, 2011

(87) PCT Pub. No.: WO2010/056935

PCT Pub. Date: May 20, 2010

(65) Prior Publication Data

US 2011/0269346 A1 Nov. 3, 2011

Related U.S. Application Data

(60) Provisional application No. 61/114,897, filed on Nov. 14, 2008.

(51) Int. Cl.
*H01R 4/66* (2006.01)

(52) U.S. Cl.
USPC ..... 439/108

(58) Field of Classification Search
USPC ..... 439/108, 607.01, 607.05, 541.5, 439/74–75
See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,399,372 | A | 8/1968 | Uberbacher |
| 3,482,201 | A | 12/1969 | Schneck |
| 3,538,486 | A | 11/1970 | Shiesinger |
| 3,587,028 | A | 6/1971 | Uberbacher |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |
| 3,867,008 | A | 2/1975 | Gartland |

(Continued)

FOREIGN PATENT DOCUMENTS

| | | |
|---|---|---|
| EP | 0 273 683 A2 | 7/1988 |
| EP | 0 635 910 B1 | 6/2000 |

(Continued)

*Primary Examiner* — Chandrika Prasad
(74) *Attorney, Agent, or Firm* — Stephen L. Sheldon

(57) ABSTRACT

A connector assembly is provided that is suitable for controlling the resonance frequency of ground terminals used to shield high-speed differential pairs. Ground terminals may be commonized so as to provide ground terminals with a predetermined maximum electrical length. Reducing the electrical length of the ground terminal can move a resonance frequency of the ground terminals of the connector outside the range of frequencies at which signals will transmitted.

24 Claims, 12 Drawing Sheets

(56) References Cited

U.S. PATENT DOCUMENTS 4,030,792 A 6/1977 Fuerst
4,076,362 A 2/1978 Ichimura
4,155,059 A * 5/1979 Doi ..... 333/214
4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,523,296 A 6/1985 Healy, Jr.
4,560,222 A 12/1985 Dambach
4,571,014 A 2/1986 Robin et al.
4,664,458 A 5/1987 Worth
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,973,271 A 11/1990 Ishizuka et al.
4,975,066 A 12/1990 Sucheski et al.
4,975,069 A 12/1990 Fedder et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,174,770 A 12/1992 Sasaki et al.
5,181,855 A 1/1993 Mosquera et al.
5,228,864 A 7/1993 Fusselman et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A 2/1994 Broeksteeg
5,288,949 A 2/1994 Crafts
5,302,135 A 4/1994 Lee
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,429,520 A 7/1995 Morlion et al.
5,431,578 A 7/1995 Wayne
5,475,922 A 12/1995 Tamura et al.
5,522,727 A 6/1996 Saito et al.
5,558,542 A 9/1996 O'Sullivan et al.
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A * 4/1997 Andrews ..... 439/607.1
5,634,821 A 6/1997 Crane, Jr.
5,637,019 A 6/1997 Crane, Jr. et al.
5,672,064 A 9/1997 Provencher et al.
5,697,799 A 12/1997 Consoli et al.
5,713,746 A 2/1998 Olson et al.
5,713,767 A 2/1998 Hanson et al.
5,730,609 A 3/1998 Harwath
5,741,144 A 4/1998 Elco et al.
5,741,161 A 4/1998 Cahaly et al.
5,766,023 A 6/1998 Noschese et al.
5,795,191 A 8/1998 Preputnick et al.
5,817,973 A 10/1998 Elco et al.
5,820,392 A 10/1998 Lin et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,893,761 A 4/1999 Longueville
5,902,136 A 5/1999 Lemke et al.
5,904,581 A 5/1999 Pope et al.
5,908,333 A 6/1999 Perino et al.
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,042,427 A 3/2000 Adriaenssens et al.
6,050,862 A 4/2000 Ishii
6,068,520 A 5/2000 Winings et al.
6,086,386 A 7/2000 Fjelstad et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,154,742 A 11/2000 Herriot
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,212,755 B1 4/2001 Shimada et al.
6,215,076 B1 4/2001 Inagawa et al.
6,219,913 B1 4/2001 Uchiyama
6,220,896 B1 * 4/2001 Bertoncini et al. ..... 439/607.1
6,227,882 B1 5/2001 Ortega et al.
6,241,535 B1 6/2001 Lemke et al.
6,267,604 B1 7/2001 Mickievicz et al.
6,269,539 B1 8/2001 Takahashi et al.
6,280,209 B1 8/2001 Bassler et al.
6,293,827 B1 9/2001 Stokoe et al.
6,299,483 B1 10/2001 Cohen et al.
6,299,484 B2 10/2001 Van Woensel et al.
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.

6,371,773 B1 4/2002 Crofoot et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,537,086 B1 3/2003 MacMullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,647 B1 4/2003 Cohen et al.
6,561,849 B2 5/2003 Naito et al.
6,565,388 B1 5/2003 Van Woensel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,607,402 B2 8/2003 Cohen et al.
6,623,310 B1 9/2003 Billman et al.
6,633,490 B2 10/2003 Centola et al.
6,638,079 B1 10/2003 Billman et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,659,808 B2 12/2003 Billman et al.
6,672,907 B2 1/2004 Azuma
6,692,272 B2 2/2004 Lemke et al.
6,695,627 B2 2/2004 Ortega et al.
6,717,825 B2 4/2004 Volstorf
6,736,664 B2 5/2004 Ueda et al.
6,746,278 B2 6/2004 Nelson et al.
6,749,439 B1 6/2004 Potter et al.
6,762,067 B1 7/2004 Quinones et al.
6,764,341 B2 7/2004 Lappoehn
6,776,649 B2 8/2004 Pape et al.
6,786,771 B2 9/2004 Gailus
6,805,278 B1 10/2004 Olson et al.
6,808,399 B2 10/2004 Rothermel et al.
6,808,420 B2 10/2004 Whiteman et al.
6,824,391 B2 11/2004 Mickievicz et al.
6,797,215 B2 12/2004 Avery et al.
6,835,072 B2 12/2004 Simons et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,869,292 B2 3/2005 Johnescu et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 5/2005 Kline et al.
6,902,411 B2 6/2005 Kubo
6,913,490 B2 7/2005 Whiteman et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winings et al.
6,979,215 B2 12/2005 Avery et al.
6,994,569 B2 2/2006 Minich et al.
7,001,188 B2 2/2006 Kobayashi
7,021,975 B2 4/2006 Lappohn
7,040,901 B2 5/2006 Benham et al.
7,044,794 B2 5/2006 Consoli et al.
7,090,501 B1 8/2006 Scherer et al.
7,094,102 B2 8/2006 Cohen et al.
7,097,506 B2 8/2006 Nakada
7,101,191 B2 9/2006 Benham
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,137,832 B2 11/2006 Mongold et al.
7,139,176 B2 11/2006 Taniguchi et al.
7,153,162 B2 12/2006 Mizumura et al.
7,172,461 B2 2/2007 Davis et al.
7,175,446 B2 2/2007 Bright et al.
7,179,108 B2 2/2007 Goodman et al.
7,186,123 B2 3/2007 Lemke et al.
7,207,807 B2 4/2007 Fogg
7,241,168 B2 7/2007 Sakurai et al.
7,278,856 B2 10/2007 Minich
7,281,950 B2 10/2007 Belopolsky
7,285,018 B2 10/2007 Kenny et al.
7,309,239 B2 12/2007 Shuey et al.
7,310,875 B2 12/2007 Evans
7,331,802 B2 2/2008 Rothermel et al.
7,331,830 B2 2/2008 Minich
7,335,063 B2 2/2008 Cohen et al.
7,371,117 B2 5/2008 Gailus
7,396,259 B2 7/2008 Marshall
7,431,616 B2 10/2008 Minich
7,467,955 B2 * 12/2008 Raistrick et al. ..... 439/75
7,497,736 B2 3/2009 Minich et al.
7,524,209 B2 4/2009 Hull et al.
7,534,142 B2 5/2009 Avery et al.
7,758,385 B2 7/2010 Davis et al.
7,762,843 B2 * 7/2010 Minich et al. ..... 439/607.05
7,837,504 B2 * 11/2010 Hull et al. ..... 439/607.05
7,862,347 B2 1/2011 Amleshi et al.
7,972,151 B2 * 7/2011 He et al. ..... 439/108
8,096,832 B2 * 1/2012 Minich et al. ..... 439/607.05
8,137,127 B2 * 3/2012 Hunkins et al. ..... 439/485
2003/0181077 A1 9/2003 Rothermel et al.
2004/0157477 A1 8/2004 Johnson et al.
2004/0224559 A1 11/2004 Nelson et al.
2005/0170700 A1 8/2005 Shuey et al.
2005/0196987 A1 9/2005 Shuey et al.
2005/0227552 A1 10/2005 Yamashita et al.
2006/0003628 A1 1/2006 Long et al.
2006/0073709 A1 4/2006 Reid
2006/0094292 A1 5/2006 Shindo
2006/0189212 A1 8/2006 Avery et al.
2006/0192274 A1 8/2006 Lee et al.
2006/0228912 A1 10/2006 Morlion et al.
2006/0232301 A1 10/2006 Morlion et al.
2008/0026608 A1 1/2008 Sano et al.
2008/0096433 A1 4/2008 Bixler et al.
2008/0233800 A1 9/2008 Cai et al.

FOREIGN PATENT DOCUMENTS

EP 0 891 016 B1 10/2002
EP 1 148 587 B1 4/2005
JP 06-236788 8/1994
JP 07-114958 5/1995
JP 11-185886 7/1999
JP 2000-003743 1/2000
JP 2000-003744 1/2000
JP 2000-003745 1/2000
JP 2000-003746 1/2000

| | | | |
|---|---|---|---|
| WO | WO 90/16093 | A1 | 12/1990 |
| WO | WO 01/29931 | A1 | 4/2001 |
| WO | WO 01/39332 | A1 | 5/2001 |
| WO | WO 02/101882 | A2 | 12/2002 |
| WO | WO 2004/030158 | A2 | 4/2004 |
| WO | WO 2006/031296 | A2 | 3/2006 |
| WO | WO 2006/105535 | A1 | 10/2006 |
| WO | WO 2009/111283 | A2 | 9/2009 |

* cited by examiner

FIG.7
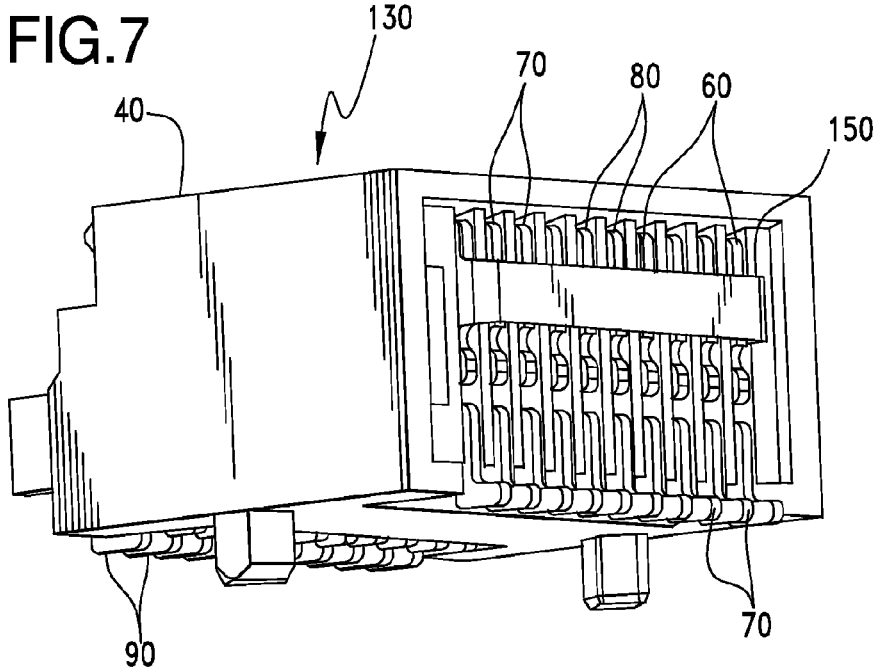
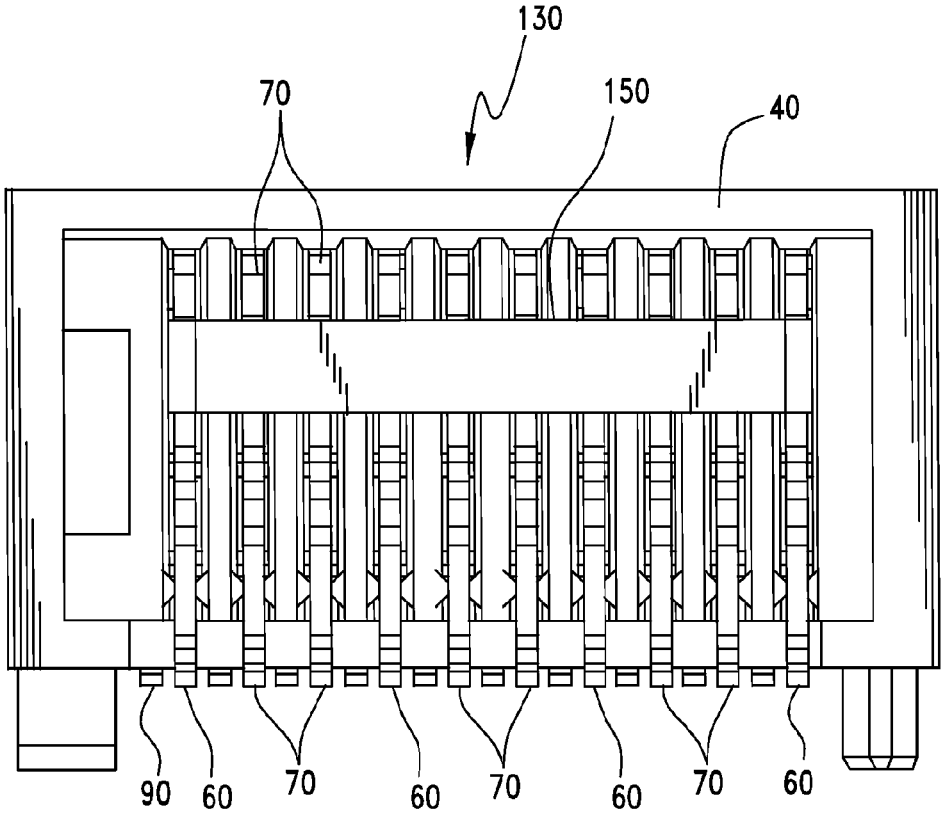
FIG.8

CONNECTOR WITH TERMINALS FORMING DIFFERENTIAL PAIRS

This application is a national phase of PCT Application No. PCT/US09/64300, filed Nov. 13, 2009, which in turn claims priority to U.S. Provisional Ser. Application No. 61/114, 897, filed Nov. 14, 2008, both of which are incorporated herein by reference in their entirety.

BACKGROUND OF THE INVENTION

The present invention generally relates to connectors suitable for high-speed communication.

While a number of different configurations exist for high-speed connectors, one common configuration is to align a number of terminals in a row so that each terminal is parallel to the adjacent terminal. It is also common for such terminals to be closely spaced together, such as at a 0.8 mm pitch. Thus, high-speed connectors tend to include a number of tightly spaced and similarly aligned terminals.

High-speed communication channels tend to use one of two methods, differential signals or single-ended signals. In general, differential signals have a greater resistance to interference and therefore tend to be more useful at higher frequencies. Therefore, high-speed connectors (e.g., high-frequency capable connectors) such as the small form factor pluggable (SFP) style connector tend to use a differential signal configuration. One issue that has begun to be noticed with increased importance is that as the frequency of the signals increases (so as to increase the effective data communication speeds), the electrical and physical length of the connector becomes more of a factor. In particular, the electrical length of the terminals in the connector may be such that a resonance condition can occur within the connector because the effective electrical length of the terminals and the wavelengths contained in the signaling become comparable. Thus, even connectors systems configured to use differential signal pairs begin to have problems as the frequency increases. Consequentially, the potential resonance condition in existing connectors tends to make them difficult or unsuitable for use in higher speed applications. Accordingly, improvements in the function, design and construction of a high-speed connector assembly would be appreciated by certain individuals.

SUMMARY OF THE INVENTION

A connector includes a plurality of ground and signal terminals, creating a complex transmission structure. The resultant resonant frequency of two ground terminals may be modified by coupling the two ground terminals together with a bridge so as to provide predetermined maximum electrical length associated with a particular resonance frequency. In an embodiment, two ground terminals may be coupled together via a bridge that extends transversely to a differential signal pair of terminals where the differential signal pair is positioned between the two ground terminals. In an embodiment an air gap may exist between the bridge and the differential signal pair. In an embodiment, a bridge may be used to couple two or more ground terminals. In an embodiment, a unified set of two or more ground terminals may be configured so as to provide an integrated set of terminals coupled together so as to provide a desired maximum electrical length.

BRIEF DESCRIPTION OF THE DRAWINGS

FIG. 7 is an axonometric view of another embodiment of a connector assembly with ground clips;

FIG. 8 is front view of another embodiment of a connector with a ground clip;

DETAILED DESCRIPTION OF THE ILLUSTRATED EMBODIMENTS

Figure 1:
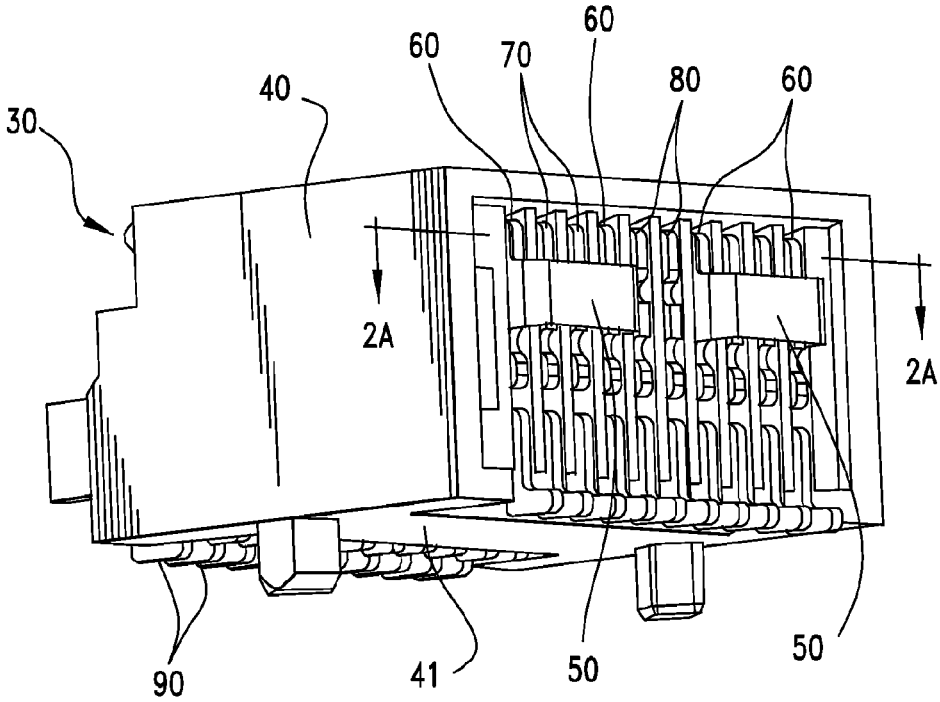
FIG. 1 is an axonometric view of an embodiment of a connector assembly with ground clips.

As required, detailed embodiments are disclosed herein; however, it is to be understood that the disclosed embodiments are merely exemplary and the depicted features may be embodied in various forms. Therefore, specific details disclosed herein are not to be interpreted as limiting, but merely as a basis for the claims and as a representative basis for teaching one skilled in the art to variously employ the disclosed features in virtually any appropriate manner, including employing various features disclosed herein in combinations that might not be explicitly described.

Small form pluggable (SFP) style connectors are often used in systems where an input/output (I/O) data communication channel is desired. It should be noted that used herein, the phrase SFP style connector refers generically to connector that can similar functionality to what is provided by a SFP standard based connector, however it is not so limited but instead refers to the general construction and thus includes QSFP, XSP SFP+ and other variations. An actual SFP connector has two high-speed data paths, each formed by a different differential signal pair, and also includes a number of other terminals that may be used for other purposes other than high-speed data communication. Other connectors use a similar form factor and may have a similar design but may be configured to provide some other number of high-speed signal pairs. Consequentially, the details discussed herein, which based on an embodiment of a connector suitable for use as the SFP-style connector, are not so limited but instead are also broadly applicable to other connector configurations as well. Thus, features of the disclosure may be used for vertical and angled connectors as well as the depicted horizontal connector. In other words, other terminal and housing configurations, unless otherwise noted, may also be used.

Adjacent terminals, when used to form a high-speed differential pair, electrically couple together to form what can be called a first, or intentional, mode. This mode is used to transmit signals along the terminals that make up the differential pair. However, if other signal terminals are also nearby this differential signal pair, it is possible that one (or both) of the terminals in the differential pair may also electrically couple to one or more of the other terminals (thus forming additional, sometimes unintentional, modes). These additional modes are undesirable or at least less desirable, as they can introduce cross-talk that acts as noise relative to the first mode. To prevent such cross-talk, therefore, it is known to shield the differential pair from other signals.

Therefore, because of the above-noted tendency to have the terminals located relatively close to each other, differential signal pairs are often separated by a ground terminal or a shield. For example, a ground-signal-signal-ground pattern may be used and this results in a differential signal pair being surrounded by a ground on each side when the pattern is aligned in a row. One issue that does arise because of the shielding ground terminals is that another mode is caused by the coupling between the ground terminal and the signal pair terminals. In addition, the difference in voltage between two different grounds can also cause the grounds to couple together as transient signals pass through the connector. These various coupling create additional modes (and resultant electromagnetic fields) and introduce noise that must be distinguished from the first mode if the communication system is going to work effectively.

The additional modes generally are not a problem in low frequency data transmission rates as they tend to be limited in power compared to the first mode and thus do not cause a serious noise issue, assuming the connector is otherwise properly designed. However, as the frequency of data transmission increases, the wavelength associated with the harmonic content of the signal decreases, bringing the wavelength of the signal closer to the electrical length of the terminal. Therefore, at these higher frequencies, it is possible that the transmission frequency will be high enough and the wavelength short enough to create resonance in the connector that occurs within the relevant operational frequency range. Such resonance can amplify the secondary modes sufficiently to raise the noise level as compared to the signal level so that it becomes difficult to distinguish between the signal and the noise at the higher frequencies.

One way to address the noise issue is to raise the level of the signal. Doing so, however, takes power and creates additional strain on the rest of the system. Furthermore, the increased power may create greater levels of resonance. Therefore, a connector that can minimize resonance in the relevant frequency range of signaling can provide certain advantages. It has been determined that decreasing the effective electrical length of the ground terminals, which effectively decreases the length between ground discontinuities, can provide significant benefits in this regard. In particular, decreasing the electrical length of the terminal so that it is not more than one half the electrical length associated with a particular frequency (e.g., the electrical length between discontinuities is about one half the electrical length associated with a wavelength at the 3/2 Nyquist frequency) has been determined to significantly improve connector performance. It should be noted however, that in certain embodiments the actual electrical length of the terminal is not the effective electrical length of the connector because there is an additional distance traveled outside the connector before a discontinuity is encountered. Therefore, a connector with an actual electrical length of about 40 picoseconds might, in operation provide an effective electrical length of about 50 picoseconds. As can be appreciated, this difference can be significant at higher frequencies as a difference of 10 picoseconds in electrical length could result in a connector suitable for about 20 Gbps performance versus one suitable for about 30 Gbps performance.

As it is often not practicable to shorten the entire connector, the resonance problem has proven difficult to solve in a manner that is economical. To address this problem, however, it has been determined that a bridge can be used to connect multiple ground terminals so as to provide terminals with a maximum electrical length. The commoning of the grounds act to shorten the electrical length between discontinuities and raises the resonant frequency, thus allowing increased frequencies to be transmitted over the connector without encountering resonance within the operating range of the signal connector. For example, placing a ground clip so that it couples two terminals together at their physical mid-point can cut the electrical length of the connector approximately in half and therefore raises the resonant frequency by doubling it. In practice, a bridge has a physical dimension as it extends between the two ground terminals, placing a bridge at the physical midpoint may not cut the electrical length exactly in half but the reduction can be relative close to half the original electrical length. It has been determined that a SFP-style connector with an effective electrical length of about 50 picoseconds can include a bridge placed so as to provide terminals portions with electrical lengths of less than about 38 picoseconds extending from both sides the bridge. Such an electrical length is suitable to allow signals at more than about 8.5 GHz to pass through the connector without creating problematic resonance conditions. This translates to a connector that potentially allows data rates, when using a non-return to zero (NRZ) signaling method, of about 17 Gbps. Careful placement of the bridge may allow the electrical length to be cut approximately in half, thus a connector with an original electrical length of about 50 picoseconds can be configured so that the portions have electrical lengths of about 26 picoseconds (and thus may be suitable for 25 Gbps performance). As can be appreciated, for a terminal with a shorter effective electrical length (such as one that is originally about 40 picoseconds in effective electrical length) a bridge can be readily placed so that the electrical length of the terminal on either side of the bridge is below a lower predetermined maximum electrical length (such as, but not limited to about 26 picoseconds). Such an effective electrical length will increase the resonant frequency of the ground-to-ground mode to above about 19-20 GHz, such that using a NRZ signaling method, a data rate of about 25 Gbps is potentially achievable. As can be appreciated, therefore, a shorter original electrical length may allow for subsequently shorter electrical lengths when a bridge is utilized. The desired maximum electrical length will vary depending on the application and the frequencies being transmitted.

In one embodiment, the connector can be configured so as to reduce the maximum electrical length so as to shift the resonant frequency sufficiently, thereby providing a substantially resonance free connector up to the Nyquist frequency, which is one half the sampling frequency of a discrete signal processing system. For example, in a 10 Gbps system using NRZ signaling, the Nyquist frequency is about 5 GHz. In another embodiment, the maximum electrical length may be configured based on three halves (3/2) the Nyquist frequency, which for a 10 Gbps system is about 7.5 GHz, for a 17 Gbps system is about 13 GHz and for a 25 Gbps system is about 19

GHz. If the maximum electrical length is such that the resonance frequency is shifted out of the 3/2 Nyquist frequency range, a substantial portion of the power transmitted, potentially more than 90 percent, will below the resonant frequency and thus most of the transmitted power will not cause a resonance condition that might otherwise increase the noise. The remainder of the transmitted power may contribute to background noise but for many applications the transmission media absorbs much of the power and the receiver may filter out the higher frequencies, thus the resultant, relatively modest, residual background noise is not expected to negatively impact the signal to noise ratio to such a degree that operation will be seriously impacted.

It should be noted that the actual frequency rate and ranges of probable electrical lengths for shorting purposes vary depending upon materials used in the connector, as well as the type of signaling method used. The examples given above are for the NRZ method, which is a commonly used high-speed signaling method. As can be appreciated, however, in other embodiments two or more ground terminals may be coupled together with a bridge at a predetermined maximum electrical length so that the connector is effective in shifting the resonance frequency for some other desired signaling method. In addition, as is known, electrical length is based on the inductance and capacitance of the transmission line in addition to the physical length and will vary depending on geometry of the terminals and materials used to form the connector, thus similar connectors with the same basic exterior dimensions may not have the same electrical length due to construction differences. Therefore, testing a connector is typically the simplest method of determining the electrical length of the terminals.

FIG. 1 illustrates one embodiment of a connector assembly generally designated 30. The connector assembly 30 includes a housing 40 with a bottom wall 41, a plurality of ground members 50 (ground members being an example of a bridge), a plurality of ground terminals 60, a plurality of high-speed signal terminals 70, a plurality of functional terminals 80 in a first row and offset terminals 90 in a second row. The functional and offset terminals may be used, without limitation, to transmit low speed signals and/or power and the like, as desired. The housing 40 can be made of any desirable material, such as, but without limitation, a high temperature polymer. The terminals can be made of any desirable conductive material, such as a copper alloy and may be coated in a desirable manner so as to provide the desired corrosion and wear properties. Similarly, the bridge, if distinct from the terminals, can be a desirable composition, such as a copper alloy with an appropriate plating. As can be appreciated, the terminals in a particular row may all have the same design but such uniformity is not required. The term "bridge" as used herein is used to describe a conductive structure that joins two ground terminals together and it may also be referred to as a clip, a shorting bar, a bus bar or any other communing structure.

As depicted, the connector assembly 30 includes a receptor slot 43 (FIG. 5A) that includes a first wall 43*a* and a second wall 43*b* into which portions of the terminals protrude in order to effect mating engagement with another mating component, not shown, but typically an edge or circuit card of an opposing, mating connector. It should be noted that while not required, the depicted embodiment of FIG. 5A has the bridge 50 positioned so that it is substantially positioned within the region defined by the first wall 43*a* and the second wall 43*b*. As can be appreciated, for an SFP style connector, such positioning helps control the electrical length between the bridge 50 and an end 61 of the ground terminal 60 so as to reduce the effective electrical length, potentially below about 26 picoseconds. Furthermore, as depicted the bridge 50 is positioned so as to be adjacent an open section of the housing 40 (e.g., the terminals are exposed as the back of the housing 40 is open). Thus, in an embodiment the bridge 50 extends transversely past the high-speed signal terminals 70 with only air separating the bridge 50 from the high-speed signal terminals 70. It should also be noted that as depicted, although not required, the bridge 50 extends outside of an edge 40*a* of the housing 40. While this causes a slight increase in the size of the profile of the housing, which is generally undesirable, the performance improvements possible with such a design can make such a modification beneficial in spite of the size increase.

Figure 3A:
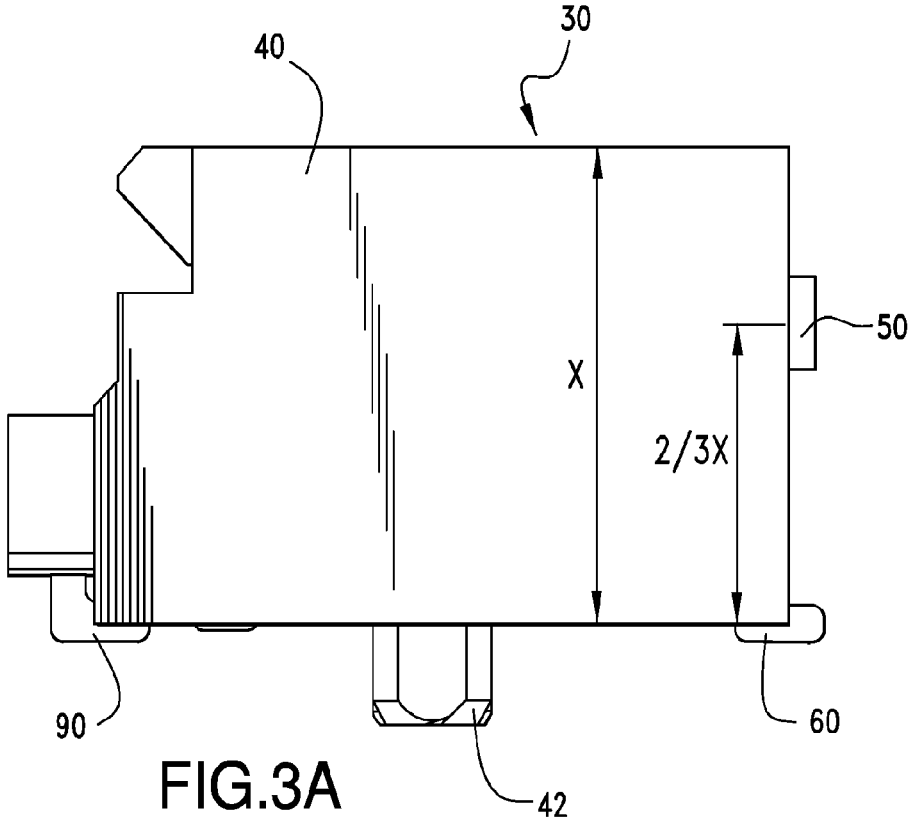
FIG. 3A is a side view of the connector of FIG. 1.
Figure 3B:
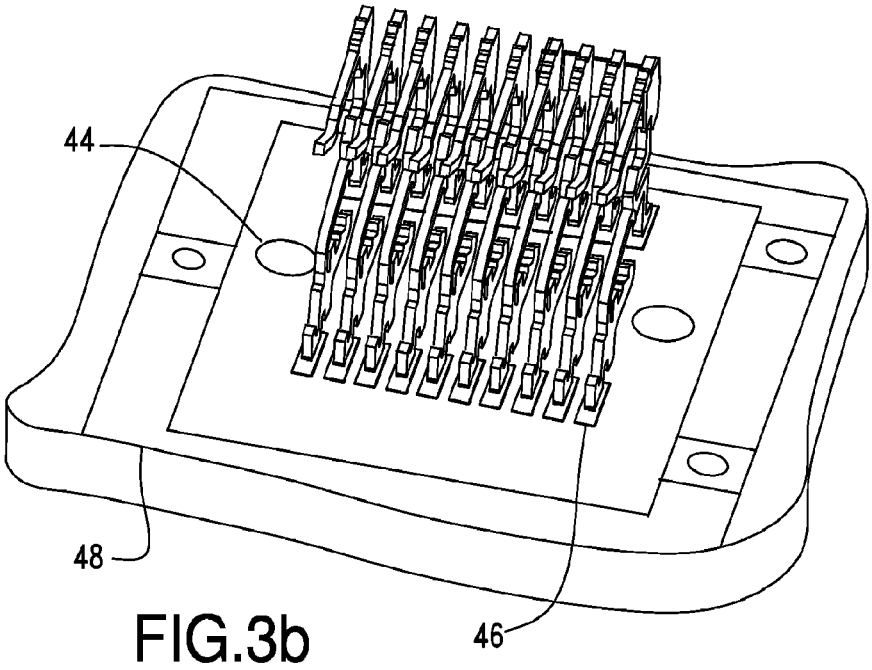
FIG. 3B is a partial axonometric view of the connector in FIG. 3A that illustrates terminals mounted on the printed circuit board.
Figure 4:
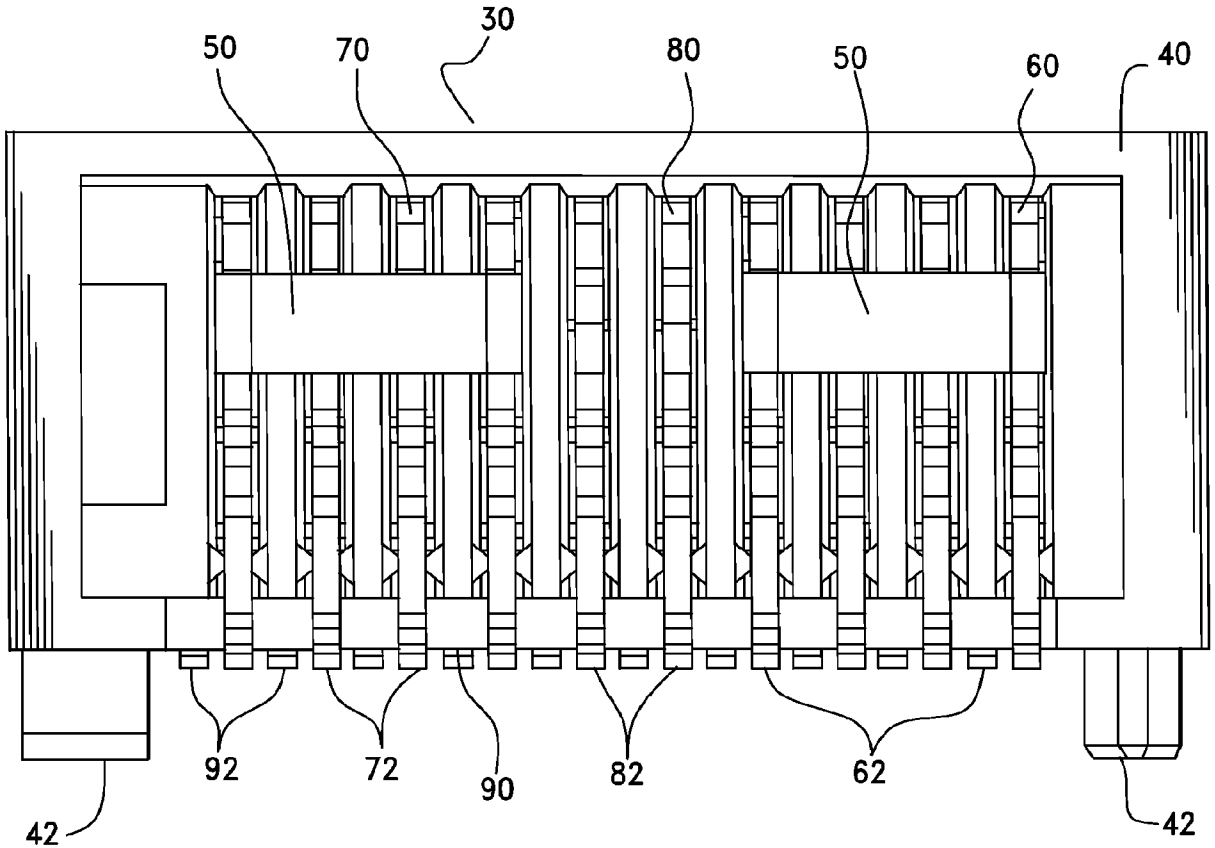
FIG. 4 is a front view of the connector assembly of FIG. 1.

The connector assembly 30 provides high-speed transmission between a mating component and another member such as a printed circuit board 48 (FIGS. 3A and 3B). Other connector arrangements and other mating engagement configurations can be suitable for accommodating the high-speed features disclosed herein.

Figure 2:
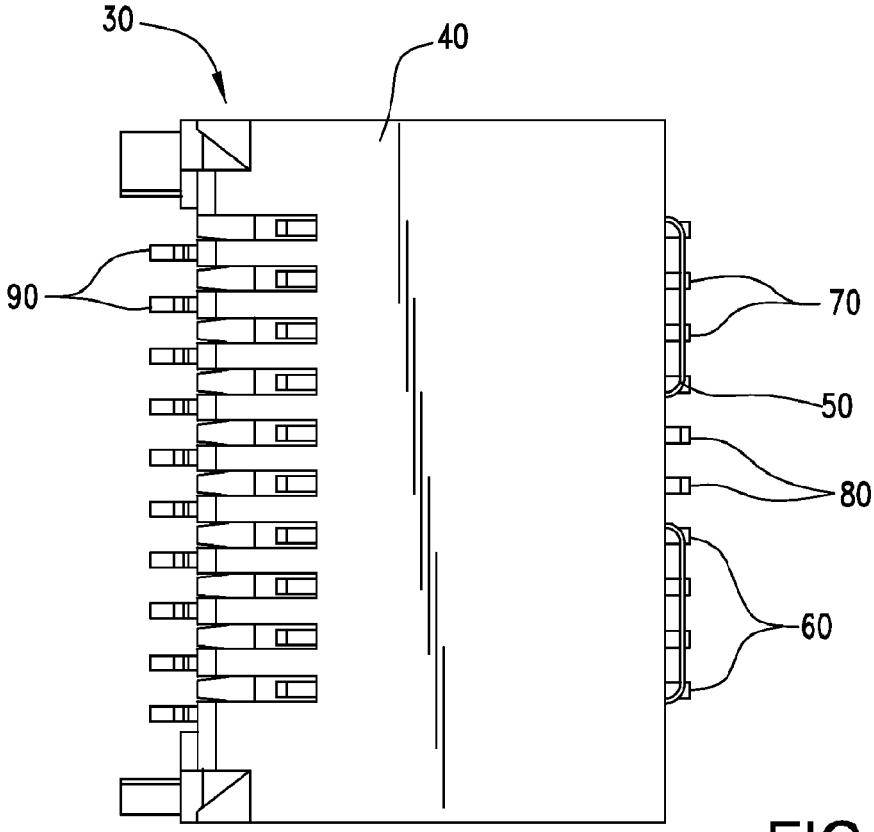
FIG. 2 is a top plan view of the connector assembly of FIG. 1.
Figure 2A:
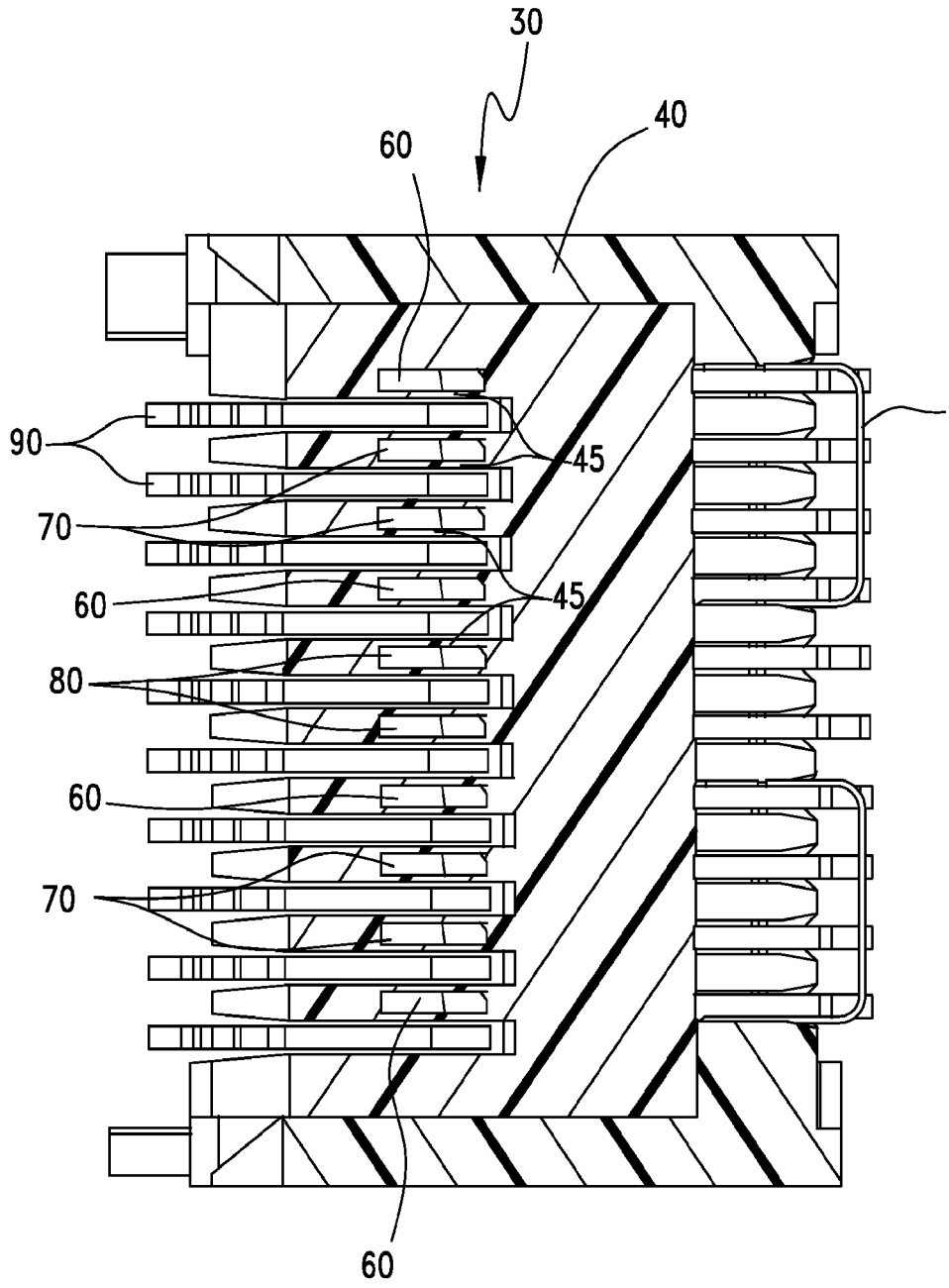
FIG. 2A is a plan view of the connector assembly of FIG. 1 taken along the line 2A-2A of FIG. 1.

As illustrated in FIGS. 2 and 2A, the offset contacts 90 in the second row are located within the housing 40 such that the offset terminals 90, the ground terminals 60, the high-speed signal terminals 70 and the functional terminals 80 are each separated from each other by portions of housing 40. The offset terminals 90 of the second row are also in a staggered position in relation to the ground terminals 60, high-speed signal terminals 70 and functional terminals 80 of the first row and the offset terminals 90 may also be generally parallel to and spaced from each other. It should be noted that in an embodiment, the offset terminals 90 and the functional terminals 80 may also be used for high-speed signal communication.

As illustrated in FIGS. 3, 3A, 3B and 4, the connector assembly 30 includes guide posts 42 that extend below the bottom wall 41. While not required, this allows the guide posts 42 to engage with guide channels 44 in a printed circuit board 48. Tail portions 62, 72, 82 and 92 of the respective terminals extend toward and engage with contact areas 46 on the printed circuit board 48. In an embodiment, the tail portions may extend below the bottom wall 41.

In an embodiment with terminals that include a U-shaped, or meander, channel portion 200, the center of the bridge 50 may be situated between the bottom wall 41 and a top wall 45 (FIGS. 3A, 5A) and positioned about two thirds (2/3) of the way up from the bottom wall 41. While not required, such a configuration allows the bridge to extend transversely past the high-speed terminals 70 with an air gap and also allows the bridge to be positioned a predetermined maximum electrical distance from the ends 61 of the ground terminal 60. In another embodiment which positions the bridge at a desired height, the bridge is positioned so that its bottom edge is located between about 0.45 and 0.55 H from the bottom surface of the terminal 62 or the top surface of the circuit board, wherein H is shown as extending between the bottom surface of the terminal 62 or the top surface of the circuit board and the top surface 45 of the connector as shown by H in FIG. 5A. For a thru-hole tail, H will extend from the circuit board to the top of the connector. When the bridge is placed at least 0.5 H from the circuit board surface of an SFP style connector, it provides the ground terminals with an effective maximum electrical length of less than about 38 picoseconds and more preferably less than about 33 picoseconds. The centralities of such bridges may be located at between about 0.55 to 0.62 H from the circuit board surface. It has been discovered that with the bridge located in such areas, the resonant frequency of the connector is increased above the operational frequency of the connector, which for a data transmission rate of about 12.5 Gbps may be about 9.4 GHz and may extend up to an operational frequency of 10 GHz.

Figure 5:
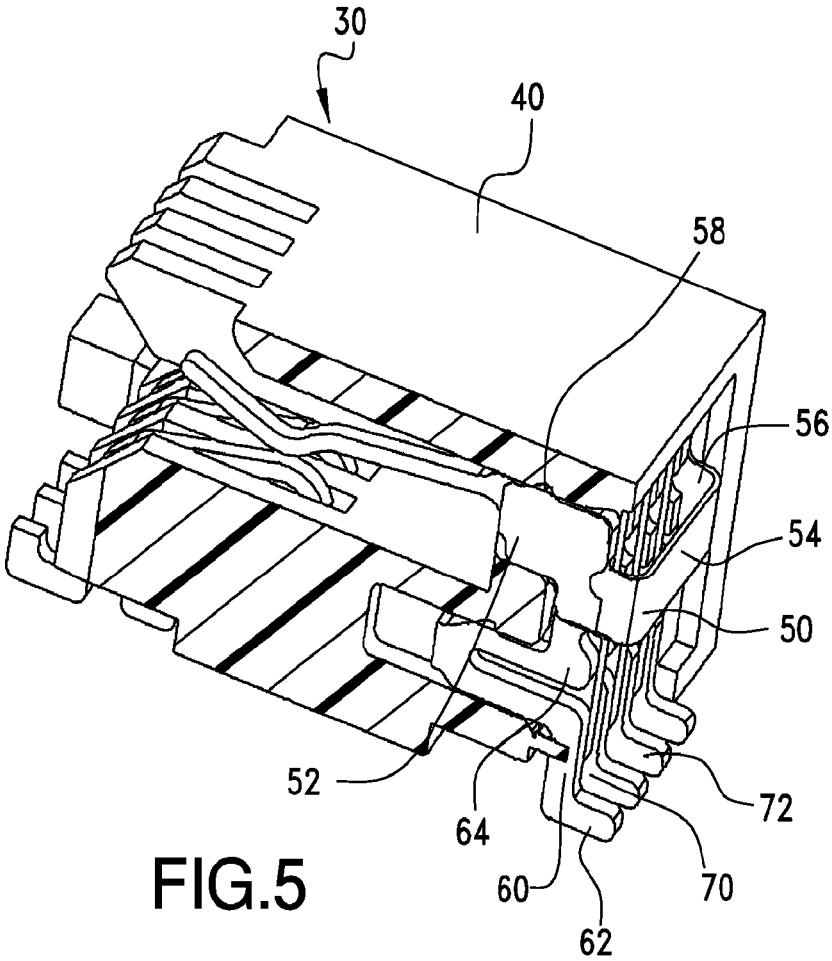
FIG. 5 is a longitudinally cut-away axonometric view of the connector assembly of FIG. 1.
Figure 6:
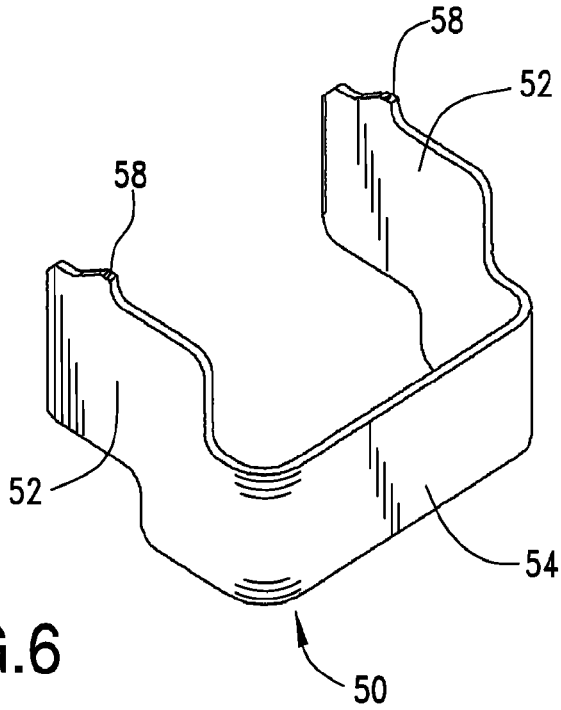
FIG. 6 is an axonometric view of an embodiment of a ground clip.
Figure 5A:
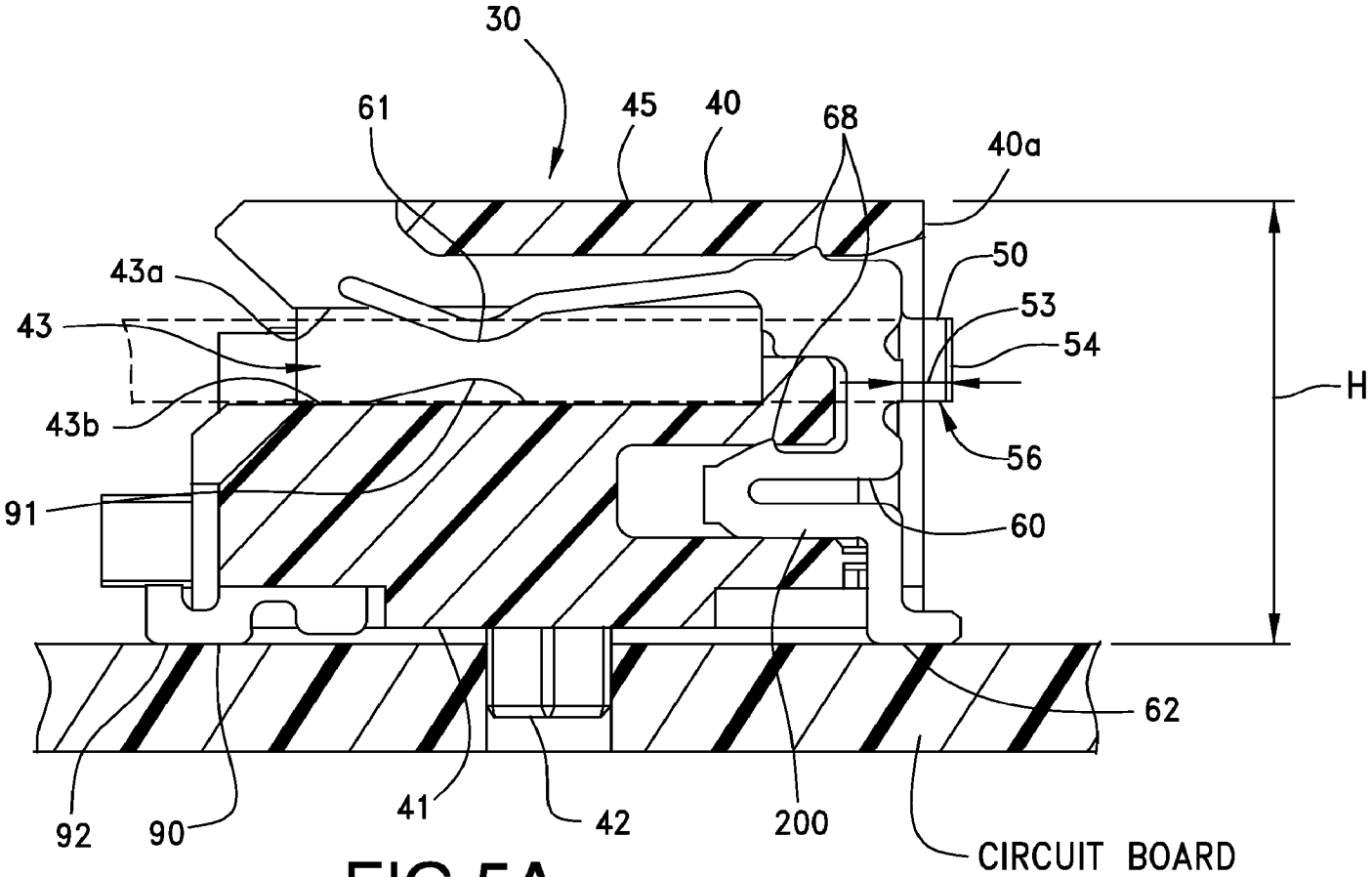
FIG. 5A is a longitudinally cross-sectioned view of the connector assembly of FIG. 1.

As illustrated in FIGS. 5, 5A, 6, the bridge 50 includes side walls 52 and a front wall 54. As illustrated, the side walls 52 of the bridge 50 make contact with the outside surfaces 64 of the ground terminals 60. In an embodiment, the bridge 50 may be sized and shaped to engage the ground terminals 60 so as to be retained due to friction (e.g., via a friction fit or by slidingly engaging the ground terminal). Alternatively, the bridge 50 can be coupled to the ground terminals 60 using any desirable method, such as retaining fingers that engage a notch. The advantage of using a friction fit as depicted is that certain embodiments of the bridge 50 can be a simple shape and easily mounted to the connector. The front wall 54 of the bridge 50 extends between the side walls in a direction transverse to the high-speed signal terminals 70. It should also be noted that the front wall 54 extends transversely to the high-speed terminals in a section where the high-speed terminals are exposed. This allows an air gap 56 to be provided between the front wall 54 and the high-speed signal terminals 70 such that there is no physical contact between the bridge 50 and the high-speed signal terminals 70. The air gap is a distance 53, which in an embodiment may be about 0.5 mm, which advantageously provides good electrical separation.

Preferably the distance 53 is sufficient so that the electrical separation between the bridge and the high-speed signal terminals 70 is greater than the electrical separation between the two terminals that make up the signal pair. It should be noted that while an air gap 56 with a distance of 0.5 mm may actually place the bridge 50 slightly closer to the high-speed terminals 70 than the high-speed terminals 70 are to each other (in an embodiment with an 0.8 mm pitch, for example, they can be more than 0.5 mm apart), the dielectric constant of air as compared to the dielectric constant of the housing acts to increase the electrical separation. Therefore, from an electrical standpoint the separation between the bridge 50 and the high-speed signal terminals 70 is significantly more than the separation between adjacent high-speed signal terminals. In an embodiment, the bridge 50 may be spaced from the high-speed terminals 70 so that the value of the distance 53 times an average dielectric constant of the material(s) between the bridge and the terminals (which in the depicted embodiment is air with a dielectric constant of about 1) is less than three quarters (¾) the value of the distance between the terminals times the average dielectric constant of the material(s) separating the high-speed signal terminals at the point where the bridge crosses the terminals. In another embodiment, the value of the distance 53 times the average dielectric constant of the material(s) between the bridge and the terminals is less than one half (½) the value of the distance between the terminals high-speed signal times the average dielectric constant of the material(s) separating the terminals at the point where the bridge crosses the terminals.

As depicted, the side wall 52 has a retention barb 58 (FIGS. 5 and 6) that corresponds to a terminal retention barb 68 on the ground terminal 60 (FIG. 5A), both of which engage the housing 40. It should be noted, however, that the retention barb 58 does not need to be orientated as shown and could, for example, be facing down or in another desirable direction. The use of the retention barb, however, helps ensure that vibration will not cause the bridge 50 to vibrate loose once installed. It should be noted that while the side walls 52 are positioned in the same position vertically with respect to the receptor slot 43, the front wall 54 is offset with respect to the receptor slot. An advantage of this configuration, while not required, is that it allows openings in the housing 40 that are otherwise used to secure the terminals to also be utilized to secure the bridge 50. This configuration can also allow the bridge 50 to effectively be shifted along the length of the ground terminal 60, as desired, so as to fine tune the electrical lengths of the ground terminals 60 on either side of the bridge 50. In an embodiment this can allow the length of the electrical length of the ground terminal on both sides of the bridge to be within 20 percent of each other. In another embodiment, the electrical lengths of the ground terminal on both sides of the bridge 50 may be within 10 percent of each other. One method of testing the resultant electrical length is to bisect the connector at the bridge and then test the terminal from the middle of the bridge to its endpoint to determine the electrical length. It should be noted that in operation the mating interface will likely some additional electrical length between the contact pad and the first point of commoning within the circuit card. Therefore, the effective electrical length of the connector will be larger than the actual electrical length of the connector.

As depicted, the bridge 50 is positioned so as to common the two ground terminals 60 at a point that reduces the electrical length of the terminals that make up the ground terminal and in an embodiment may reduce the electrical length to about one-half the original electrical length of the ground terminals 60. In an embodiment, for example, the electrical length between the bridge and the ends of the terminal may be less than about 26 picoseconds. Depending on the frequencies being used, however, an effective maximum electrical length of less than about 33, 38 or even 45 picoseconds may be sufficient. It should be noted that in an embodiment the electrical length of the terminals on both sides of a single bridge may be such that electrical length of a portion of the terminal on a first side of the bridge is within 25 percent of a portion of the terminal on the second side of the bridge. This can allow the resonance performance of the connector to be significantly improved and for certain connector designs is sufficient to reduce the resultant effective maximum electrical length of the ground terminals below a desired value, such as 38, 33 or 26 picoseconds.

Referring back to FIG. 1, it should be noted that terminals 80 may also be used as high-speed terminals. Such a configuration is depicted in FIGS. 7 and 8, where the terminals 80 are used as high-speed terminals 70 (and thus both labels apply). As can be appreciated, in such a configuration a connector assembly 130 would provide three high-speed data channels. Thus, depending on the configuration, a connector may include a desirable number of high-speed data channels. As depicted, the connector assembly 130 includes a bridge 150 that extends across and couples four ground terminals 60. As can be appreciated, therefore, a bridge can couple any desirable number of ground terminals together. Furthermore, it should be noted that the bridge may be multiple links that couple together to form the bridge. For example, two bridges such as depicted in FIG. 9B (discussed below) could share a common peg but extend in opposite directions from the shared peg. Thus, a number of variations are possible.

Figure 9A:
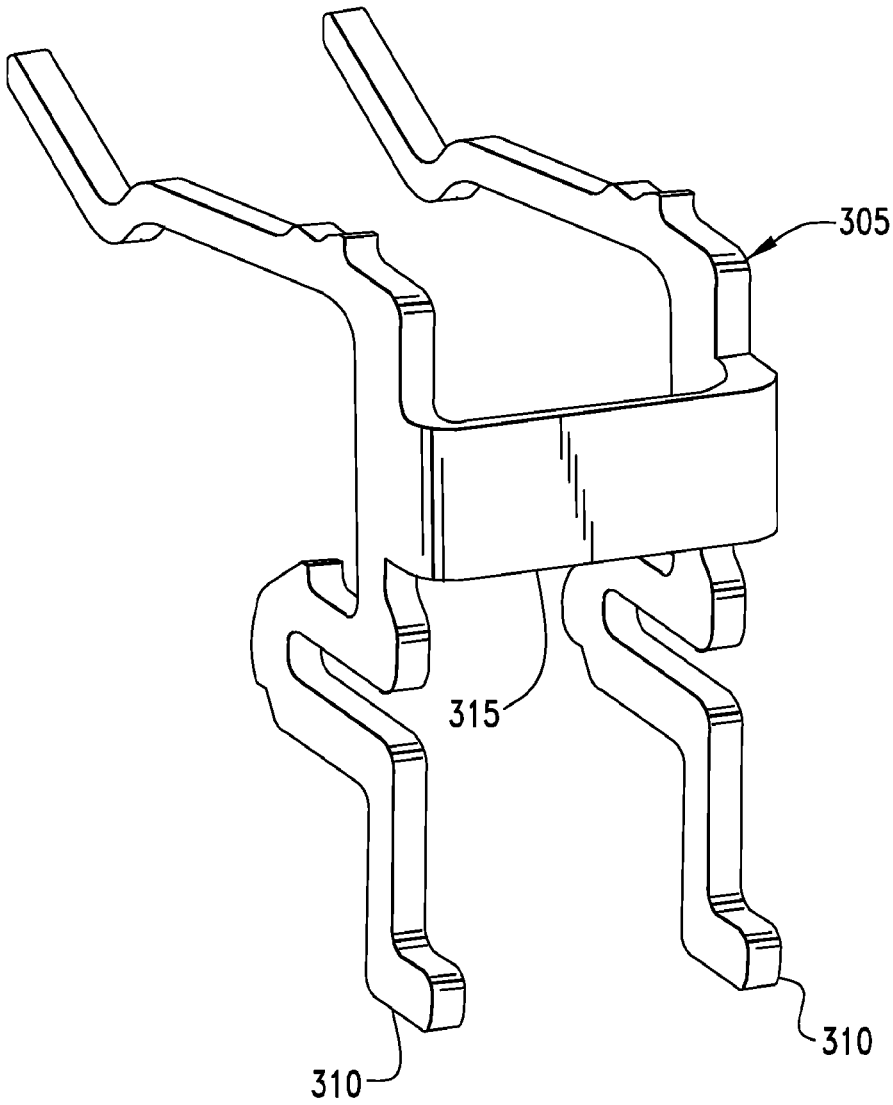
FIG. 9A is an axonometric view of an embodiment of an integral ground terminals and ground clip unit.
Figure 9B:
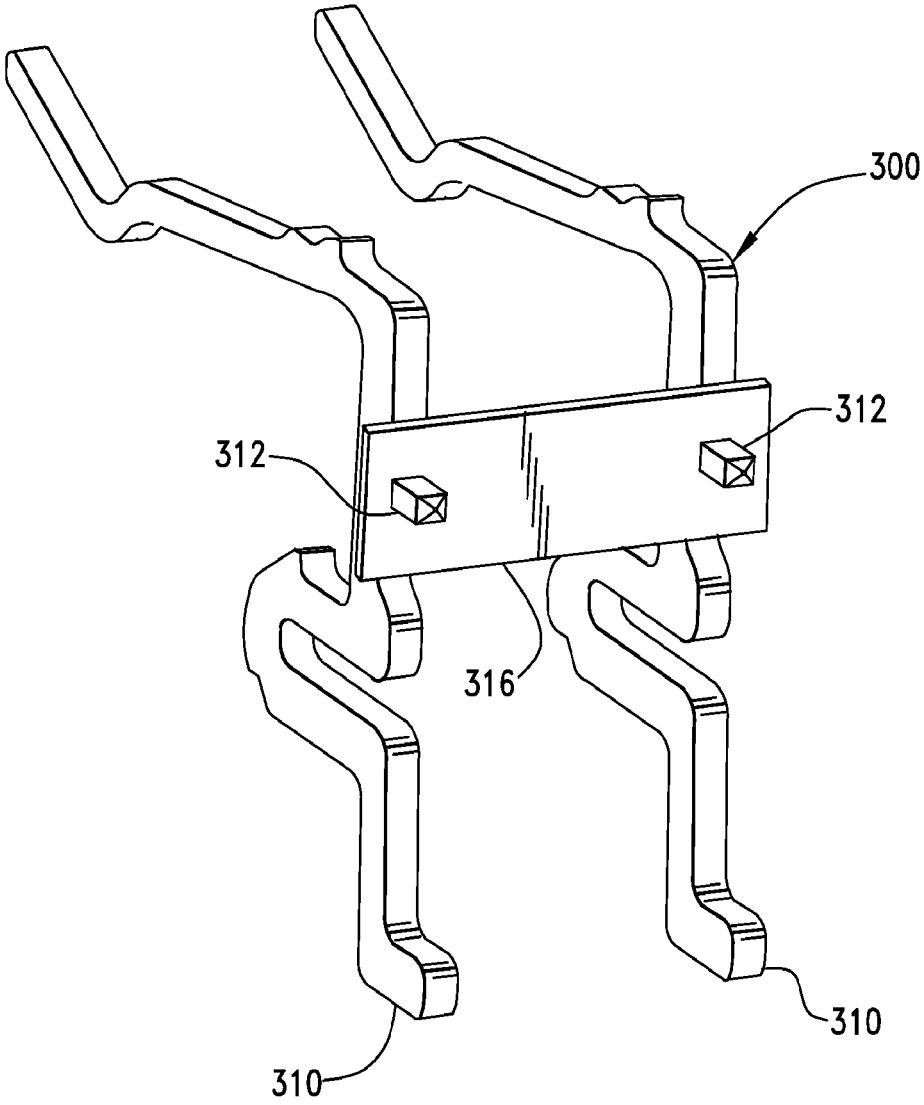
FIG. 9B is an axonometric view of another embodiment of a bridge coupled to two ground terminals.
Figure 10A:
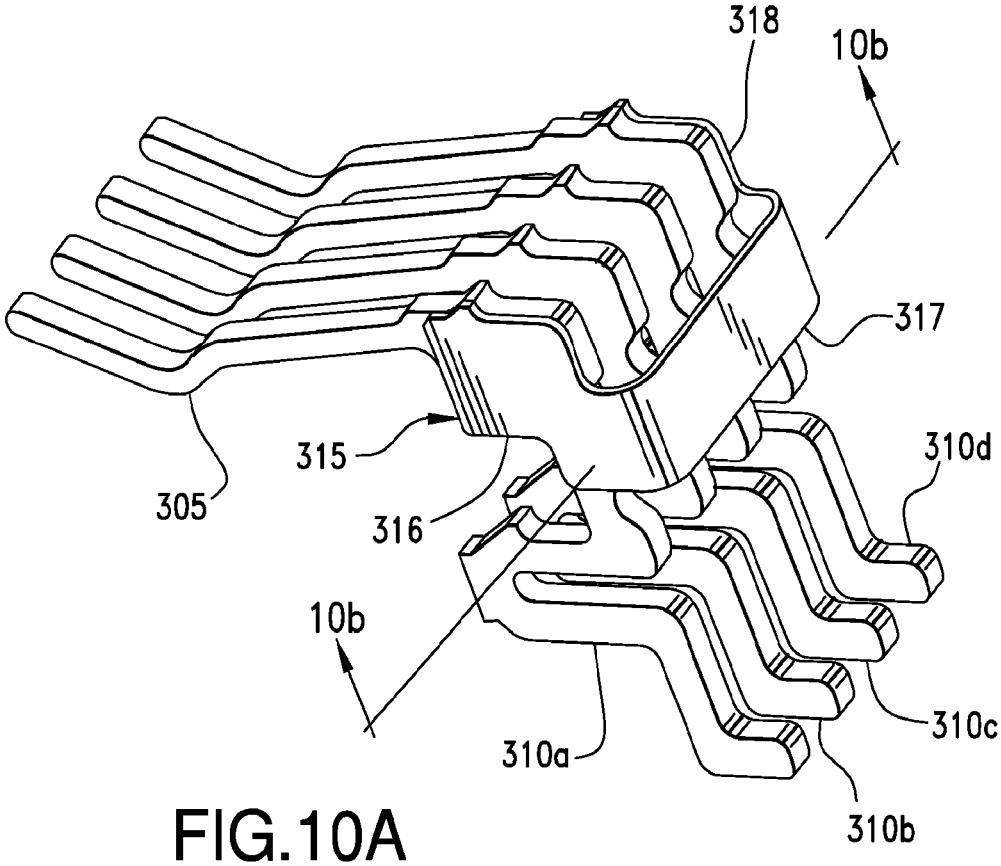
FIG. 10A is an axonometric view of an embodiment of ground terminals bridged together and surrounding a signal pair.

As further illustrated in FIG. 9A, an integral grounded terminal unit 300 can be used. In this embodiment, a bridge 315 is made to be integral with a pair of ground terminals 310 to form a single component. Any number of two or more ground terminals 310 can be connected together by one or more bridges 315 as desired. While FIG. 9A illustrates ground terminals such as might be formed from a single stamping, the bridge 315 and ground terminals 310 may be connected by desirable method such as soldering or welding, for example. Thus, the integral grounded terminal unit 300 can be formed and shaped as desired, either by combining separate elements or by forming a more complex shape, such as is possible with a stamping and bending process, for example. FIG. 9B illustrates another embodiment of a grounded terminal unit 305 with a bridge 316 positioned on pegs 312 that extend from the ground terminals 310. The bridge 316 can be inserted onto the pegs 312 via a conventional press-fit operation and may also be soldered into place. As can be appreciated, the pegs 312 may be of variable dimensions so as to allow the bridge 316 to be mounted to but not to slide all the way down the pegs (thus allowing the bridge 316 to be offset from the high-speed signal terminals that can be positioned between, as depicted in FIG. 10*a*). Further, any combination of integral grounded terminal unit 300 and ground terminal unit 305 may be used in a connector system. In addition, the pegs 312 may be configured so as to be substantially flush with the bridge 316 once the bridge 316 is installed. Thus, for example, certain ground terminals may be combined to form an integral ground terminal unit 300 while other ground terminal in the connector may be coupled with a bridge such as bridge 50 or bridge 316 so as to form a ground terminal unit 305. Furthermore, one or more ground terminal units could be coupled together to form a chain of ground terminal units.

Figure 10B:
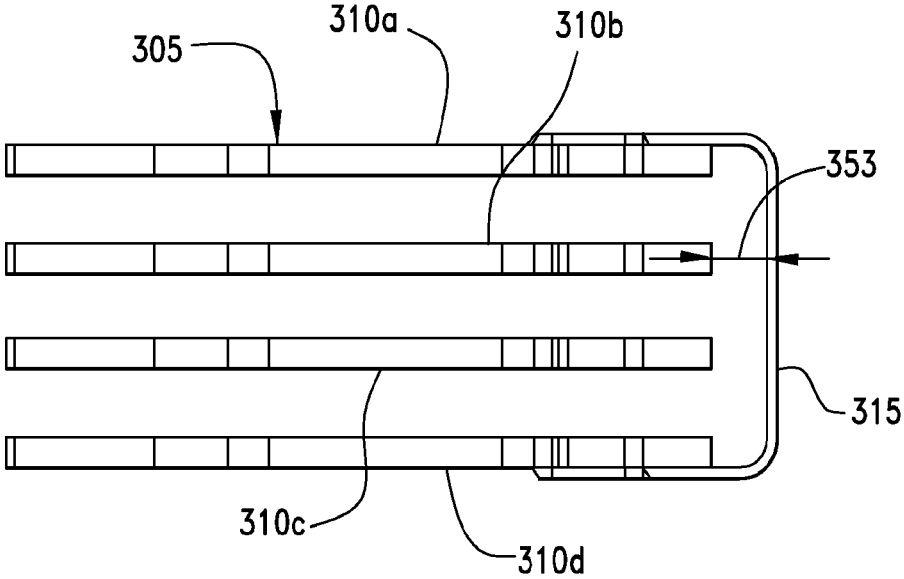
FIG. 10B is a cross sectional view of the terminals of FIG. 10A, taken along the line 10*b*-10*b*.

As can be appreciated from FIGS. 10A-10B, therefore, in an embodiment a bridge, such as bridge 316, is provided to couple ground terminals 310*a* and 310*d* while extending transversely to the high-speed terminals 310*b*, 310*c*. Consequentially, ground terminal unit 305 acts to shield the high-speed terminals while being configured to minimize resonance of modes associated within the ground terminals for a desired frequency range. In addition, the bridge 316 may be positioned so as to provide ground terminals 310*a*, 310*d* with predetermined electrical lengths. Furthermore, the bridge may be configured to be sufficiently electrically separated from the high-speed terminals 310*b*, 310*c* so as to minimize coupling between the bridge and the high-speed terminals 310*b*, 310*c*.

Figure 11:
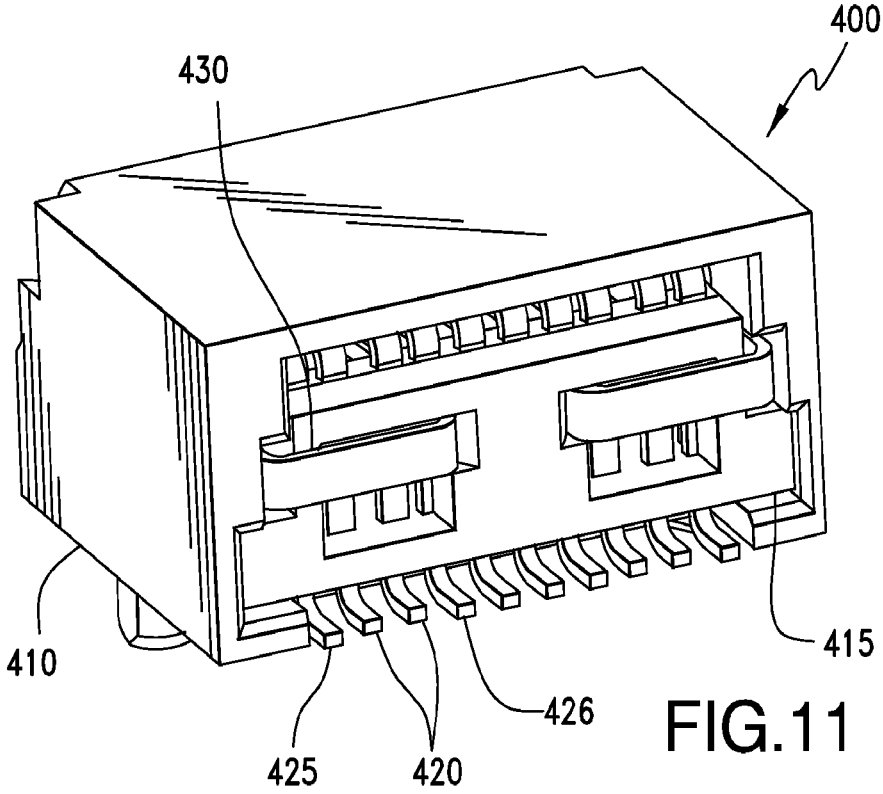
FIG. 11 is a perspective view of an embodiment of a connector with terminal insert.
Figure 12:
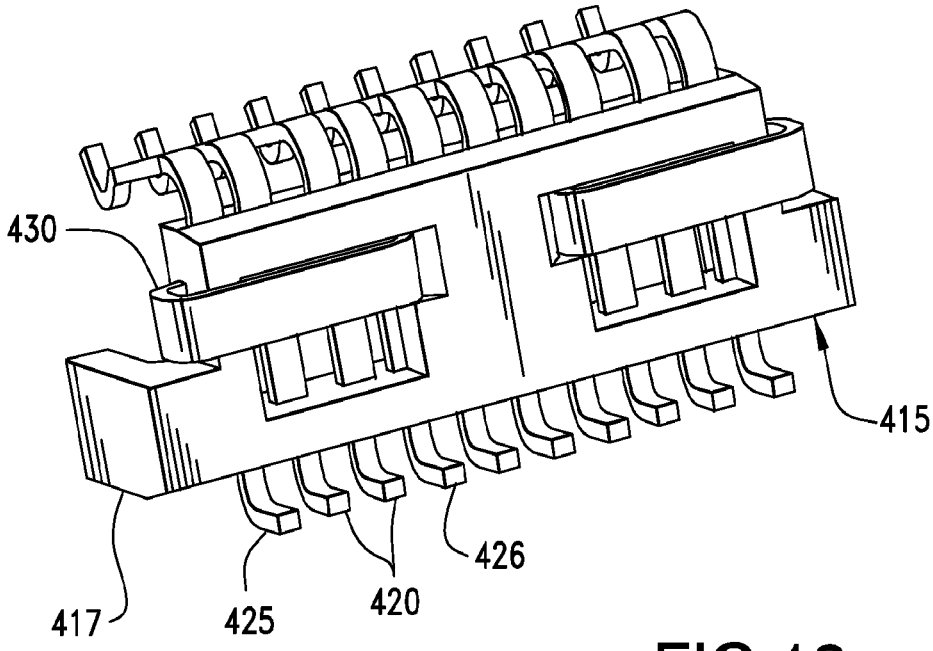
FIG. 12 is a perspective view of an embodiment of a terminal insert.
Figure 13:
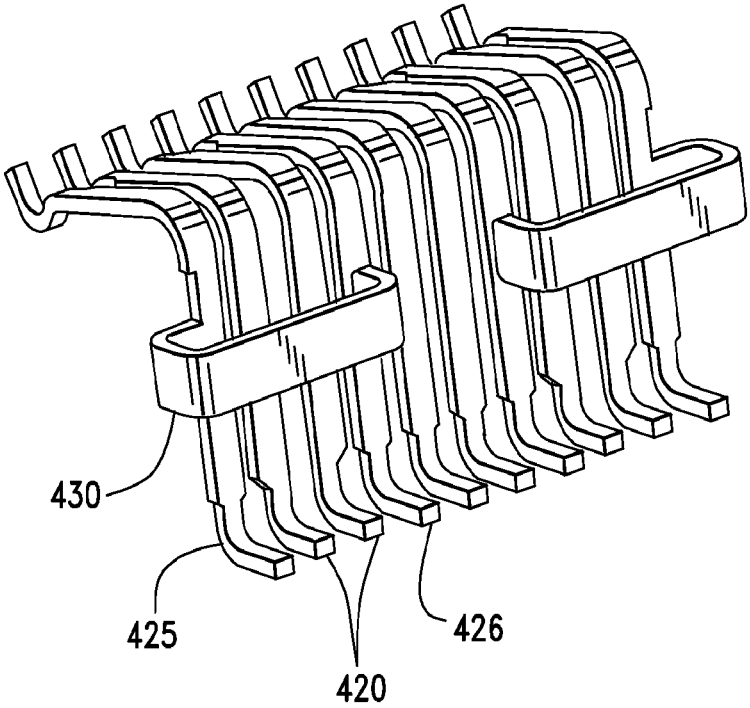
FIG. 13 is a perspective view of an embodiment of terminals that may be used in a terminal insert.

FIGS. 11-13 illustrate an embodiment of a connector 400 that includes a housing 410 that supports an insert 415. The insert 415 has a frame 417 that supports a plurality of terminals including signal terminals 420 and first ground terminal 425 and a second ground terminal 426 coupled together by bridge 430. As depicted, the bridge 430 is integrated into the first ground 425 and extends over to the second ground terminal 426. The bridge, however, can also be a separate element as depicted above. As can be appreciated, the frame 417 is formed around the terminals and supports the terminals in the housing 410. Therefore, the signal terminals may be formed so as to provide a relatively constant cross section, reducing any potential discontinuities.

It should be noted that while a single bridge is depicted and may be sufficient for smaller connectors, a connector with larger dimension (e.g., longer terminals) may benefit from additional bridges. Thus, two bridges may be placed on a pair of ground terminals so as to ensure the three resultant electrical lengths are each below a maximum electrical length. For example, looking at FIG. 5 a first bridge could be positioned adjacent the top of the housing 40 and a second bridge could be positioned adjacent the u-shaped channel. Consequentially, the use of a bridge is not limited to a single bridge unless otherwise noted. In general, when a plurality of bridges are used to provide three or more electrical lengths, the ability to slidingly engage the ground terminals with the bridge is advantageous because for certain applications it may be that less bridges can be used while still providing sufficient electrical performance while for other systems that require higher performance more bridges can be used. Thus, flexibility in the performance of the connector is enabled. For smaller connectors, however, it is expected that the use of a single bridge will be more cost effective and a desired positioned of the bridge so as to obtain a particular maximum electrical length can be more readily determined.

It has been discovered that the location of a bridge may be positioned to increase the resonant frequency outside the operational frequency range of the connector. For data rates exceeding 12.5 Gbps, it is believed that the bridge should be placed above the meander section, if a meander section is used, which can result in a resonant frequency that is greater than the operating frequency of between about above 10 GHz to 20 GHz. For data rates beneath 12.5 Gbps, the bridge may be placed below the meander sections, which may result in a resonant frequency that is higher than the operational frequency of between about 1 GHz and 10 GHz. In other words, the location of bridge can be configured to ensure a predetermined maximum electrical length and that position will vary depending on the shape of the terminals.

It will be understood that there are numerous modifications of the illustrated embodiments described above which will be readily apparent to one skilled in the art, such as many variations and modifications of the resonance modifying connector assembly and/or its components, including combinations of features disclosed herein that are individually disclosed or claimed herein, explicitly including additional combinations of such features, or alternatively other types of signal and ground contacts. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

The invention claimed is:

1. A connector for mounting on a circuit board, the connector comprising:

a dielectric housing with a receptor slot, the receptor slot including a first and a second wall, the receptor slot configured to receive a circuit card from a mating connector;

a first terminal and a second terminal supported by the housing in a first row;

a third terminal and a fourth terminal supported by the housing and positioned in the first row between the first and second terminals, the third and fourth terminals configured for use as a differential pair, wherein the first, second, third and fourth terminals protrude from the first wall into the receptor slot; and a bridge extending between the first and second terminals, the bridge coupling the first and second terminal and configured so as to provide the first and second terminals with an effective maximum electrical length on both sides of the bridge.

2. The connector of claim 1, wherein the effective maximum electrical length is less than about 38 picoseconds.

3. The connector of claim 2, wherein the effective electrical maximum length is less than about 26 picoseconds.

4. The connector of claim 1, wherein the bridge extends transversely past the third and fourth terminals and in operation the bridge has a first electrical separation between the bridge and the third and fourth terminals that is substantially greater than a second electrical separation between the third and fourth terminals.

5. The connector of claim 4, wherein the bridge is separated from the third and fourth terminal by a continuous air gap.

6. The connector of claim 4, wherein there is a first distance between the third terminal and the bridge and a second distance between the third terminal and the fourth terminal and the electrical separation between the bridge and the third terminal is such that a first product of the first distance multiplied by a first average dielectric constant between the bridge and the third terminal is not more than three fourths (¾) of a second product of the second distance multiplied by a second average dielectric constant between the third and fourth terminals.

7. The connector of claim 1 wherein the bridge and the first and second terminals form an integral unit.

8. The connector of claim 1, wherein the terminals include a u-shaped section and the housing includes a bottom surface and a top surface, the bottom and the top surface being a first distance apart, wherein a center of the bridge is spaced from the bottom surface at least half the first distance.

9. The connector of claim 8, wherein the center of the bridge is spaced from the bottom surface at least two thirds (⅔) of the first distance.

10. The connector of claim 1, wherein the bridge includes matching sides walls and a front wall extending between the side walls, wherein each of the sides walls are configured to engage one of the first and second terminals and the front wall is offset with respect to the sides walls.

11. The connector of claim 10, wherein the offset causes a first effective electrical length of a portion of the first terminal on a first side of the bridge to be within 20 percent of a second effective electrical length of a portion of the first terminal on a second side of the bridge.

12. The connector of claim 1, wherein the first terminal includes a first peg and the second terminal includes a second peg and the bridge is supported by the first and second peg.

13. The connector of claim 1, wherein a first effective electrical length of a portion of the first terminal on a first side of the bridge is within 25 percent of a second effective electrical length of a portion of the first terminal on a second side of the bridge.

14. The connector of claim 1, wherein the housing includes a bottom surface and a top surface, the bottom and top surfaces being a first distance apart, wherein a center of the bridge is spaced from the bottom surface at least half the first distance, wherein the effective maximum electrical length is less than about 38 picoseconds.

15. A connector assembly, comprising:

a dielectric housing with a receptor slot; configured to receive a circuit card from a mating connector;

a first ground terminal and a second ground terminal supported by the housing, the first and second ground terminals having an original electrical length and protruding into the receptor slot;

a differential pair supported by the housing between the first and second ground terminals, the differential pair protruding into the receptor slot;

a bridge electrically connected to the first and second ground terminals, the bridge coupled to the dielectric housing via a friction fit, wherein the bridge is configured to reduce the electrical length of the first and second ground terminals below a predetermined maximum electrical length.

16. The connector of claim 15, wherein the bridge is configured to reduce the electrical length of the first and second ground terminals to less than one-half the original electrical length.

17. The connector assembly of claim 15, wherein the bridge is configured to reduce the electrical length of the first and second ground terminals to an electrical length sufficient to allow the connector, in operation, to avoid a resonance condition in the ground terminals from signals operating below about thirteen (13) GHz.

18. The connector of claim 15, wherein the effective maximum electrical length is less than about 26 picoseconds.

19. A connector, comprising:

a dielectric housing with a receptor slot configured to receive a circuit card from a mating connector;

an insert positioned in the dielectric housing, the insert including a frame and a first row of terminals supported by the frame, the first row of terminals including a first pair of terminals configured for use as high-speed differential pair; the first row of terminals further including a first ground terminal and a second ground terminal positioned on opposite sides of the first pair of terminals; and a bridge extending between the first and second ground terminals, the bridge configured to reduce an electrical length of the first and second ground terminals to a value below a predetermined maximum electrical length.

20. The connector of claim 19, wherein the effective maximum electrical length is less than about 38 picoseconds.

21. The connector of claim 19, wherein the effective maximum electrical length is less than about 26 picoseconds.

22. The connector of claim 19, wherein the bridge is a first bridge, the connector further including a second bridge extending between a third ground terminal and a fourth ground terminal, the second bridge configured to reduce an electrical length of the third and fourth ground terminals to a length below a predetermined maximum electrical length.

23. The connector of claim 19, wherein the first bridge is not electrically connected to the second bridge.

24. The connector of claim 19, wherein the bridge is formed as an integral portion of the first ground terminal.

* * * * *